343-754
7/3/84 OR 4,458,249

United States Patent [19]

Valentino et al.

[11] Patent Number: 4,458,249

[45] Date of Patent: Jul. 3, 1984

[54] MULTI-BEAM, MULTI-LENS MICROWAVE ANTENNA PROVIDING HEMISPHERIC COVERAGE

[75] Inventors: Pasquale A. Valentino, Glen Head; John J. Stangel, Mahopac; both of N.Y.

[73] Assignee: The United States of America as represented by the Secretary of the Navy, Washington, D.C.

[21] Appl. No.: 350,796

[22] Filed: Feb. 22, 1982

[51] Int. Cl.[3] ..... H01Q 19/06

[52] U.S. Cl. ..... 343/754

[58] Field of Search ..... 343/753, 754, 755, 368, 343/371, 372

[56] References Cited

U.S. PATENT DOCUMENTS 3,245,081 4/1966 McFarland ..... 343/754
3,755,815 8/1973 Stangel et al. ..... 343/100 SA

OTHER PUBLICATIONS

Rotman et al., Wide-Angle Microwave Lens; IEEE Trans. on Antennas & Propagation; pp. 623–631, Nov. 1963.

*Primary Examiner*—Eli Lieberman
*Attorney, Agent, or Firm*—Robert F. Beers; Arthur A. McGill; Prithvi C. Lall

[57] ABSTRACT

The novel multi-beam multi-lens antenna of the present invention provides multi-beam coverage over a hemisphere or greater three-dimensional spatial coverage region. In its simplest configuration, the antenna comprises two microwave lenses whose design is integrated to minimize path length errors and aberrations for beams over a 360° azimuth coverage range. The antenna comprises a 3-D focal ring bootlace first microwave lens that is a figure of revolution and a non-planar dome second microwave lens which provides the refractive properties necessary to obtain the hemispheric coverage while providing additional degrees of freedom necessary to reduce errors and aberrations of the lens system to within acceptable levels. Both lenses are time delay lenses to effect broadband operation and are circularly symmetric. This symmetry results in antenna performance that is invariant with azimuth beam position. The parameters that are available for design optimization include the bootlace lens inner and outer surface contours, the interconnecting delay lines, the relative radial positioning of the lens elements on the inner and outer surface, the dome lens surface contours and the dome delay lines in the constrained embodiment or gradient function in the dielectric embodiment. These parameters are determined to provide a minimum rms path length error across the radiating aperture in the desired beam directions.

8 Claims, 7 Drawing Figures

MULTI-BEAM, MULTI-LENS MICROWAVE ANTENNA PROVIDING HEMISPHERIC COVERAGE

BACKGROUND OF THE INVENTION

This invention is drawn to the field of microwave optics, and more particularly, to a multi-beam, multi-lens microwave antenna providing hemispheric coverage.

Many Naval applications in electronic warfare and wide-angle surveillance call for a microwave antenna the response pattern of which displays a 360° azimuth and at least a 90° elevation. U.S. Pat. No. 3,755,815, issued Aug. 28, 1973 to Stangel et al, the patentees of which are the present applicants, incorporated herein by reference, provides such an antenna system comprising a planar phased array fed dome lens. Hemispheric coverage is provided by controllably varying the phase of the planar feed array such that the radiation produced by the array is sequentially directed to preselected regions of the dome lens. The action of the dome lens is to refract the radiation producing collimated beams of electromagnetic energy over 360° of azimuth and at least 90° of elevation. The active planar phased array feed technique, however, requires complex and expensive electronic signal processing and microwave coupling modules which suitably phase the planar feed array in the transmit mode for providing the hemispheric beam scanning capability and which, in the receive mode, recover the phase information for identifying the bearing of potential threats.

The Luneberg lens comprises a sphere the index of refraction ($\eta$) of which varies as a function of the radial distance from the center of the sphere according to the relation $\eta(r)=(2-r/R)^{\frac{1}{2}}$, where R is the radius of the sphere and r is the radial coorindate of any point within the sphere. Such a lens is capable of hemispheric coverage because of the property that a feed source placed adjacent any surface point produces a collimated wavefront on the other side of the sphere travelling in the direction of the line from the feed point through the center of the sphere. However, not only is a sphere having a radially variable index of refraction difficult and expensive to construct but also considerable mechanical difficulties are encountered in controllably scanning the feed source about the spherical surface to provide hemispheric coverage. An array of feed sources positioned around the lower hemisphere up to the equatorial plane produces severe aperture blockage and pattern degradation especially for the low elevation angle beams.

SUMMARY OF THE INVENTION

The multi-beam, multi-lens microwave antenna of the present invention comprises a 3-D focal ring bootlace first microwave lens and a non-planar dome second microwave lens responsive to the first lens for providing hemispheric coverage. The dual lens configuraton of the present invention is circularly symmetric providing invariant performance over a 360° azimuthal range for a given elevation angle. The 3-D focal ring bootlace first microwave lens and the non-planar dome second microwave lens are integrated such that the first lens produces the non-linear wavefront tailored to the refracting requirements of the second microwave lens and the refracting requirements of the second microwave lens are tailored to minimize the path length errors of the first microwave lens.

The circularly symmetric 3-D focal ring bootlace first microwave lens comprises a feed array matrix having a plurality of beamports arranged along concentric closed contours; a plurality of collector elements arranged on a first selectively contoured surface; a like plurality of radiator elements arranged on a second selectively contoured surface; and a like plurality of electromagnetic conduits connecting preselected ones of the radiator and collector elements along radial rings of the same electrical length.

The circularly symmetric second non-planar dome lens can be either a constrained or a dielectric type. The constrained embodiment of the non-planar dome second microwave lens comprises a plurality of collector elements arranged on a first selectively contoured surface, a like plurality of radiator elements arranged on a second selectively contoured surface and a plurality of interconnecting lengths of electromagnetic conduits connecting preselected ones of the radiator and collector elements together along radial rings of equal electrical length. The dielectric embodiment of the non-planar dome second microwave lens comprises a core of a high dielectric material for providing refractive and gain tailoring properties and overlayed outer and inner surface matching structures for providing good transmission characteristics for electromagnetic energy passing through the lens.

According to one feature of the present invention, the feed array matrix of the circularly symmetric first 3-D bootlace focal ring microwave lens is characterized by beamports arranged on concentric closed contours. Each beamport on a given contour corresponds to a particular azimuthal direction of the antenna aperture for a preselected elevational angle. Each of the several contours correspond to respective elevational angles of the antenna aperture.

According to another feature of the present invention, the second non-planar dome microwave lens functions in a dual capacity. The second microwave lens serves to refract the non-planar wavefront of the first microwave lens for producing collimated beams in preselected directions. In addition, the second lens is designed to minimize the path length errors of the 3-D focal ring bootlace first microwave lens.

Accordingly, it is an object of the present invention to provide a multi-beam multi-lens microwave antenna providing hemispheric or greater coverage.

Another object of the present invention is to provide such an antenna that is characterized by azimuthally invariant performance for a given elevation.

Another object of the present invention is to provide such an antenna that is capable of forming a plurality of beams simultaneously the field of view of which displays a 360° azimuth.

Another object of the present invention is to provide such an antenna that displays such a field of view in a manner that depends solely on the geometry of the antenna.

Other objects, advantages and novel features of the present invention will become apparent by reference to the appended claims, to the following detailed description of the invention and to the drawings, wherein like parts are similarly designed throughout, and wherein:

DETAILED DESCRIPTION OF THE INVENTION

Figure 1:
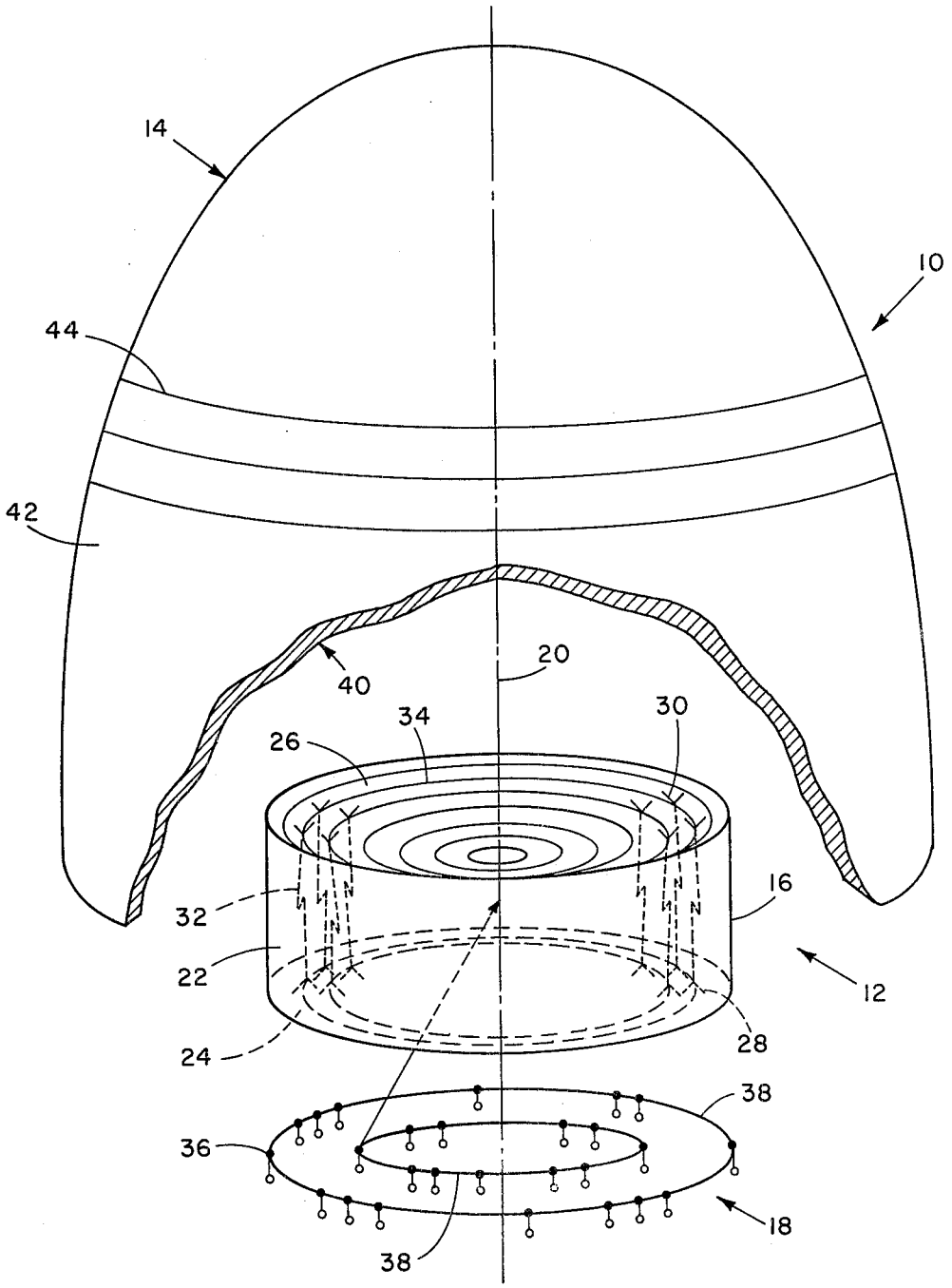
FIG. 1 is a schematic perspective diagram showing the multi-lens, multi-beam microwave antenna providing hemispheric coverage of the present invention.

Referring now to FIG. 1, generally designated at 10 is a multi-beam, multi-lens microwave antenna according to the present invention. The antenna 10 comprises a 3-D focal ring bootlace first microwave lens generally designated at 12 and a non-planar dome second microwave lens 14 spaced in the nearfield of the first microwave lens.

The 3-D focal ring bootlace first microwave lens 12 comprises a multi-beam lens 16 and a feed array matrix 18. The geometry of the multi-beam lens 16 is a figure of revolution and the array matrix 18 is circularly symmetric about the axis 20 of the antenna 10.

The multi-beam lens 16 comprises a conductive housing 22 having first and second selectively contoured surfaces 24 and 26. A plurality of collector elements 28 are mounted on the surface 24 and a like plurality of radiator elements 30 are mounted on the surface 26. A plurality of electromagnetic conduits 32 connect preselected ones of the collector elements 28 and the radiator elements 30 along rings 34 of equal electrical length. The collector elements 28 and the radiator elements 30 may suitably comprise dual polarized dipoles or microwave open-ended waveguides and the electromagnetic conduits 32 may suitably comprise preselected lengths of microwave transmission line or waveguide. The elements 28 and 30 are selectively arranged on the surfaces 24 and 26 respectively such that the interelement spacing is at most a half wavelength.

The feed array matrix 18 comprises a plurality of beamports 36 disposed along closed contours 38 concentric about the axis 20 of which two are shown. As will appear more fully below, each of the closed contours 38 is termed a focal ring because excitation of the beamports constrained to lie along a given contour produce azimuthally invariant beams for the elevation angle corresponding to the particular contour. Each contour 38 corresponds to a beam at a particular elevation angle and each of the beamports on a given contour correspond to a beam at a particular azimuthal angle of the antenna aperture.

The non-planar dome second microwave lens 14 suitably can comprise a dielectric dome lens or a constrained dome lens. The second lens 14 of the dual-lens antenna 10 of the present invention in both embodiments is a figure of revolution characterized by a lens inner selectively contoured surface 40 and a lens outer selectively contoured surface 42. Rings 44 of equal electrical length at a given elevation provide azimuthally invariant performance. The rings of constant electrical length 40 vary along the elevational angle and serve to control the gain and refracting properties of the antenna aperture.

Figure 2:
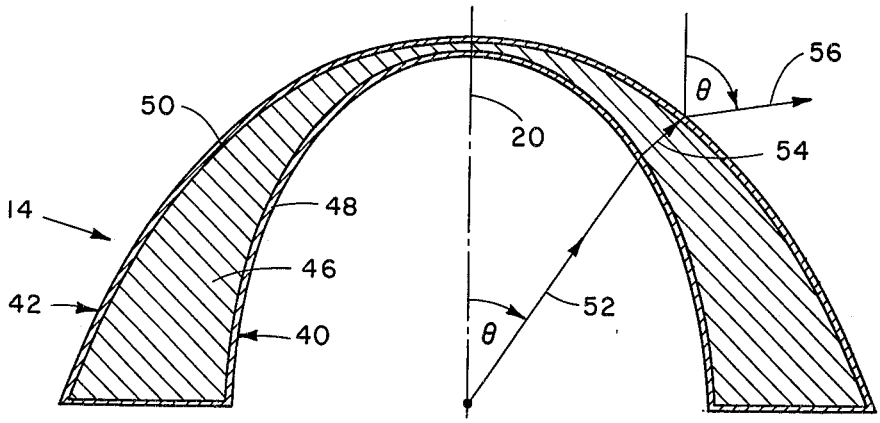
FIG. 2 is a schematic cross sectional diagram taken along the elevation plane showing a dielectric non-planar dome lens according to the present invention.

A schematic diagram illustrating the dielectric dome embodiment of the second microwave dome lens of the present invention is shown in FIG. 2. The lens 14 is configured such that its core 46 provides the refractive and gain tailoring properties of the aperture while an overlayed inner 48 and an outer 50 surface matching structure provide good transmission characteristics for energy passing through the lens. Any high ($\epsilon \gtrsim 10$) dielectric material such as a ceramic or a filled plastic may be used for the core material 46. The matching structures 48 and 50 suitably may comprise any material such as a synthetic foam, cast epoxy, or cast silicon the dielectric constant for which is selected to be intermediate that of the core material and free space. For a central ray incident on the lens 14 at an angle $\theta$, the dielectric dome lens refracts the ray as illustrated at 54. The scan amplification factor [$K(\theta)$] of the lens tailors the gain of the refracted ray producing a collimated wavefront in the direction of the ray 56 for the antenna aperture at ($\phi$, $\alpha_o$), where $\alpha_o = K(\theta) \cdot \theta$.

Figure 3:
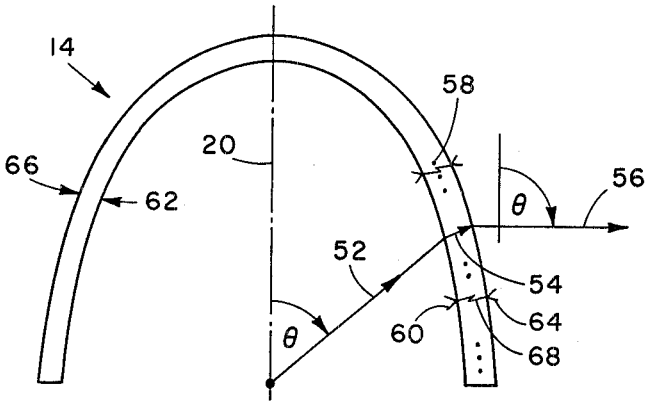
FIG. 3 is a schematic cross sectional diagram taken along the elevation plane showing a constrained non-planar dome lens according to the present invention.

A schematic diagram illustrating the constrained embodiment of the second microwave dome lens of the present inventon is shown in FIG. 3. The lens 14 in this instance comprises a housing 58 having a plurality of collector elements 60 selectively mounted on an inner selectively contoured surface 62, a like plurality of radiator elements 64 selectively mounted on an outer selectively contoured surface 66 and a plurality of electromagnetic conduits 68 connecting preselected ones of the collector and radiator elements along elevational rings of equal electrical length, not shown in FIG. 3. The elements 60 and 64 are mounted at an interelement spacing of at most one half wavelength and suitably may comprise dual polarized dipoles or microwave open-ended waveguides. The electromagnetic conduits 68 suitably may comprise microwave transmission line or waveguide of preselected electrical lengths.

Figure 4:
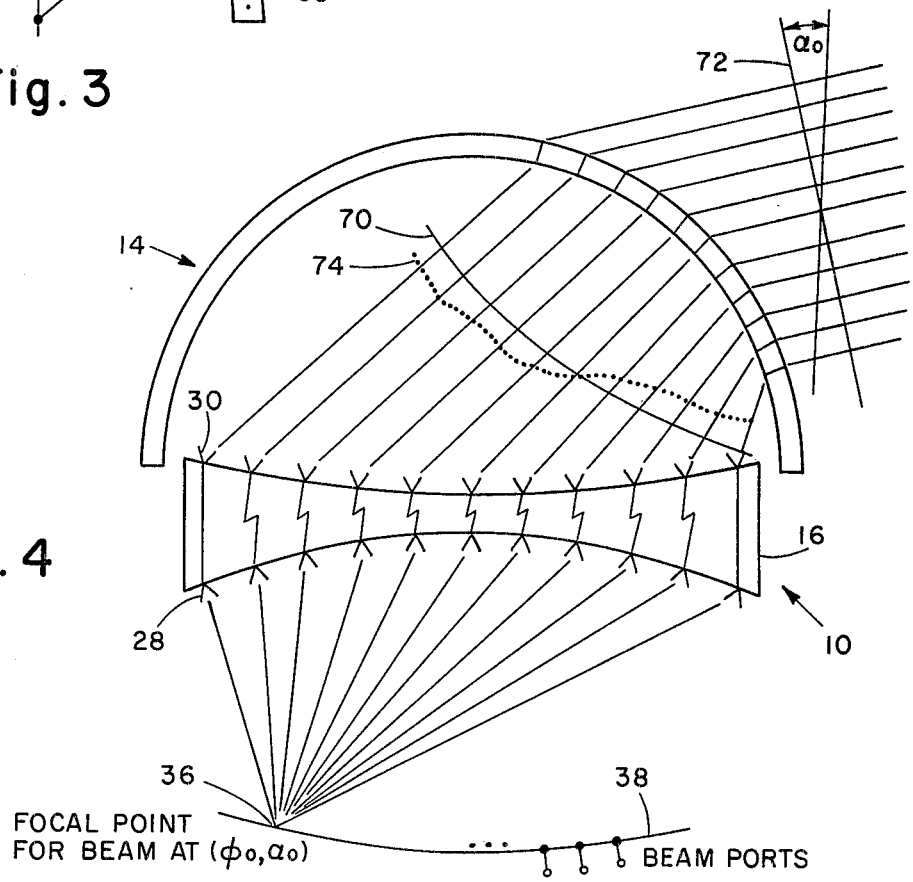
FIG. 4 is a schematic diagram illustrating the operation of the multi-lens, multi-beam microwave antenna of the present invention.

Referring now to FIG. 4, which shows a schematic diagram illustrating the operation of the multi-lens, multi-beam microwave antenna of the present invention, a beamport 36 corresponding to a particular elevation ($\alpha_o$) and azimuth ($\phi_o$) on a contour 38 illuminates in the transmit mode the collector elements 28 of the multi-beam lens 16. The optical geometry of the first lens is such that the radiator elements 30 produce a non-planar wavefront generally designated at 70 tailored to the refracting requirements of the second lens 14 for the aperture at ($\phi_o$, $\alpha_o$). The second lens 14 responds to the wavefront 70 the radiating aperture of which produces a collimated wavefront or beam 72 travelling in the ($\phi_o$, $\alpha_o$) direction. Reciprocally in the receive mode, a collimated beam 72 incident on the lens 14 is coupled through the antenna 10 such that the beamport 36 corresponding to the aperture in the ($\phi_o$, $\alpha_o$) direction is energized.

As will appear more fully below, the lens 14 of the novel integrated design of the present invention not only serves to refract the non-linear wavefront 70 but also minimizes the path length errors of the wavefront produced by the 3-D focal ring bootlace lens 12. This is schematically illustrated by the difference between the dashed line 74, which illustrates the uncompensated non-planar wavefront, and the line 70, which illustrates the compensated non-planar wavefront.

The equations and design procedure describing the multi-lens, multi-beam antenna of the present invention are as follows.

Figure 5:
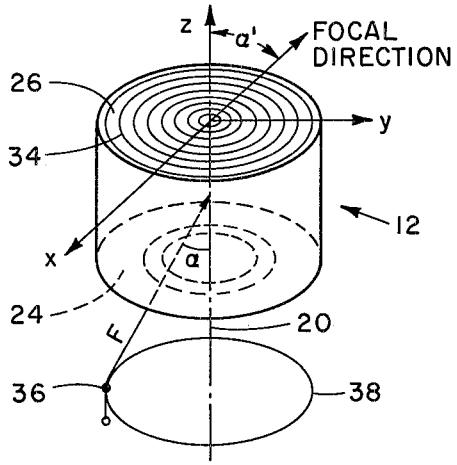
FIGS. 5 and 6 are schematic diagrams useful in explaining the design of the multi-lens, multi-beam antenna of the present invention.

Consider the circularly symmetric 3-D focal ring bootlace lens 12 of the present invention shown in FIG. 5 in spherical coordinates. The $\phi$ coordinate represents the colatitude or azimuthal angle, the $\alpha$ coordinate represents the longitudinal or elevational angle and the $\rho$ coordinate represents the radial distance from the origin.

Assume a beamport 36 described by the coordinates $(F,\alpha)$. The beamport can be taken to lie in the $\phi=0$ plane without loss of generality. The conditions for circular symmetry can be expressed as:

$$z=g_1(\rho) \tag{1}$$

$$z'=g_2(\rho') \text{ and} \tag{2}$$

$$\phi=\phi', \text{ where:} \tag{3}$$

z is the coordinate of the outer lens surface 26, z' is the coordinate of the inner lens surface 24, $\phi$ is the azimuthal angle of the outer and $\phi'$ is the azimuthal angle of the inner lens surface.

The path length function to any point on the lens defined by $(\rho,\phi)$ can be expressed as:

$$P(\rho,\phi)=(\rho'^2-2\rho'F\cos\phi\sin\alpha+(F\sin\alpha)^2+(z'-F\cos\alpha)^2)^{\frac{1}{2}}+S+F_n(\rho,\phi), \tag{4}$$

where S is the interconnecting path length between the inner and outer surfaces and $F_n(\rho,\phi)$ represents the path length condition for the ray passing through the lens at $(\rho, \phi)$ to focus the $n^{th}$ beamport in a preselected spatial direction. Equation (4) is a 3-D extension of the 2-D Gent lens equations shown and described in an article entitled "Wide-Angle Microwave Lens for Line Source Applications", by W. Rotman et al, IEEE Transactions on Antennas and Propagation, pp. 623 to 632, (November 1963), incorporated herein by reference.

If the beamport is located along a circular ring 38 concentric about the lens axis 20 with a subtended angle $\alpha$ at a $\phi$ angle of $\phi_o$, the path length error for point $(\rho,\phi)$ is:

$$P\phi_o(\rho,\phi)=(\rho'^2-2\rho'F\cos(\phi-\phi_o)\sin\alpha+(F\sin\alpha)^2+(z'-F\cos\alpha)^2)^{\frac{1}{2}}+S+F_n(\rho,\phi-\phi_o) \tag{5}$$

which is a rotation of equation (4) through $\phi_o$.

Letting $\phi=\phi-\phi_o$, equation (5) can be rewritten as:

$$P_{\phi o}(\rho,\Phi+\phi_o)=(\rho'^2-2\rho'F\cos\Phi\sin\alpha+(F\sin\alpha)^2+(z'-F\cos\alpha)^2)^{\frac{1}{2}}+S+F_n(\rho,\Phi). \tag{6}$$

Equation (6) is equivalent to equation (4) with an axis rotation through $\phi_o$. That is, the path length variation at a point on the lens $(\rho,\phi)$ due to selection of the beamport along the focal ring 38 is equivalent to the path length variation along a ring of radius $\rho$ about the lens due to a beamport excitation at $\phi_o=0$.

Thus, if an ideal path length function $P_o(\rho,\phi)$ is specified and used to design the lens resulting in the path length function $P(\rho,\phi)$, the path length error inherent in the design is:

$$E(\rho,\phi)=P(\rho,\phi)-P_o(\rho,\phi). \tag{7}$$

The rms error can then be expressed as:

$$\left(\frac{1}{\pi}\int_o^{\pi} E^2(\rho,\phi)\,d\phi\right)^{\frac{1}{2}} \text{ or,} \tag{8}$$

$$E^2\text{rms}=\frac{1}{\pi}\int_o^{\pi}(P(\rho,\phi)-P_o(\rho,\phi))^2d\phi$$

since the error variation is symmetric about the $\phi=0$ plane. The 3-D focal ring bootlace lens based on the rms path length error criteria is characterized by two non-planar surfaces 24 and 26 interconnected via fixed phase lengths that are only a function of radius, $\rho$; both surfaces are figures of revolution about the lens axis 20.

For example, consider the case for a lens designed to scan a beam $\alpha'$ from the lens axis. The phase path length function which the lens synthesizes is a plane wave in the direction $\alpha'$, $\phi=0$: $P_o(\rho,\phi)=\rho\sin\alpha'\cos\phi-z\cos\alpha'$. Normalizing the path length error to that of the center ray, not shown, and fixing the origin of the outer surface coordinate system at the center of the lens outer surface results in:

$$E(\rho,\phi)=L(\rho,\phi)-F+S+z\cos\alpha'-\rho\sin\alpha'\cos\phi, \text{ where} \tag{9}$$

$$L(\rho,\phi)=(\rho'^2-2\rho'F\cos\phi\cos\alpha+(F\sin\alpha)^2+(z'-F\cos\alpha)^2)^{\frac{1}{2}}.$$

It is noted that specifying the outer surface z results in $\rho'$, S and z' being unspecified which are the parameters with which the lens design is optimized. In general, z does not have to be specified.

Equation (8) serves as the basis for the design of the single layer circularly symmetric 3-D bootlace focal ring first microwave lens of the present invention. It will be appreciated that a lens designed in this manner is characterized by a minimum rms path length error compared to any other single layer bootlace lens designed for the same conditions, i.e. a circularly symmetric configuration with invariant azimuth beam performance. Such a lens configuration represents the simpliest design possible for a 3-D bootlace lens.

The design procedure can be extended to provide minimum error performance based on specifying more than one focal ring constraint. For example, two focal rings defined by $(F_1, \alpha_1)$ and $(F_2, \alpha_2)$ could be selected with respective focal directions $\alpha'_1$ and $\alpha'_2$. The total path length error function is the summation of the two corresponding error functions. In general, then, for N constraints:

$$E_T(\rho,\phi)=\sum_{n=1}^{N}[P_n(\rho,\alpha_n,\phi)-P_{on}(\rho,\phi,\alpha_n')] \tag{10}$$

and $$E^2_{rms}=\frac{1}{\pi}\int_o^{\pi}E_T^2(\rho,\phi)d\phi. \tag{11}$$

Rather than treat the design of the non-planar dome second microwave lens and the 3-D focal ring bootlace first microwave lens separately, their designs according to the present invention are integrated. In this manner, the dome path length delays become part of the minimum error design procedure. A schematic diagram illustrating the combined lens configuration and key parameters is shown in FIG. 6.

Figure 6:
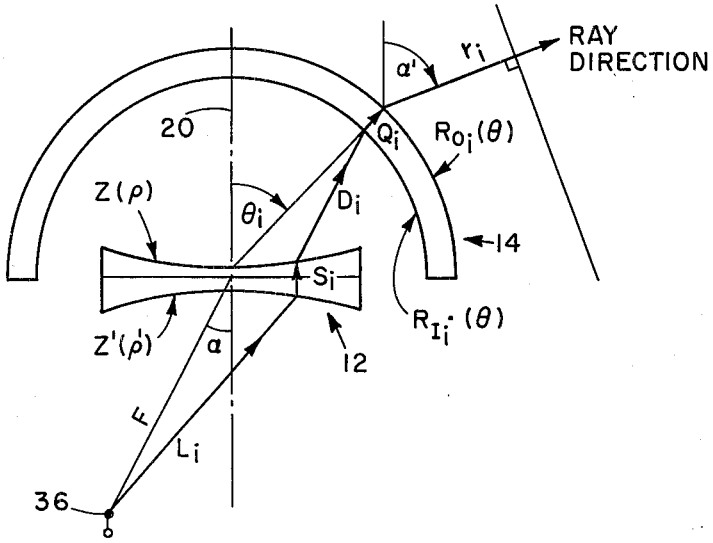

The path length function to the reference plane in FIG. 6 is given by:

$$P_i(\rho,\phi,\theta)=L_i+S_i+D_i+Q_i+r_i \quad (12)$$

where $$L_i=(\rho'^2+(F\sin\alpha)^2-2F\rho'\cos\phi\sin\alpha+(z'-F\cos\alpha)^2)^{\frac{1}{2}};$$

$S_i$ is the path length through the 3-D focal ring bootlace first microwave lens;

$$D_i=\rho^2_{Ii}+\rho'^2_i-2\rho_{Ii}\rho'_i\cos(\phi_{Ii}-\phi_i)+(z'_i-z_{Ii})^2;$$

$\rho_i=R_{Ii}\sin\theta_i$;
$z_i=R_{Ii}\cos\theta_i$;
$Q_i$=dome path length delay; and
$r_i$=distance from dome outer surface to the reference plane along a ray path.

The error is then $E_i(\rho,\phi,\theta)=P_L-P_o$, where $P_o$ is the path length of the center ray which can be used as the basis for specifying initial conditions. Since the dome lens must also be a figure of revolution in order to preserve rotational symmetry, its gradient is only in the elevational plane and is therefore characterized by rings of constant electrical path length. It is noted that if rotational symmetry were not a requirement to provide azimuthally invariant performance, the error function of the bootlace lens could be completely compensated by the dome. For such a design, the dome phase gradient would vary in both the azimuthal and elevational directions. Rays passing through these rings from the focal direction can be projected onto the 3-D focal ring bootlace first microwave outer lens surface. If the bootlace lens error function is sampled along the intercepts of the projected rings with the bootlace lens outer surface, a mean path length can be computed for each projected dome ring which minimizes the rms variation along that projected ring. In this manner, each ring of the non-planar dome second microwave lens has its path length function altered consistent with reducing the overall path length error in the focal direction. Once the dome lens design has been altered, the new phase function requirement for the bootlace first lens is computed and the bootlace lens is redesigned to satisfy this requirement. Thus, the dome lens design is based on minimizing the bootlace lens path length errors and the bootlace lens design is based on regenerating the dome phase function requirements so as to form a collimated beam in the focal direction.

The design procedure may suitably be implemented by the following steps:

(1) Assume an initial dome lens design and compute the phase function for the selected focal beam direction which is the phase necessary to excite a beam in the specified direction as if a conventional planar phased array were employed in the base plane of the dome lens as the feed array.

(2) The bootlace lens is designed to regenerate this phase function with a minimum error maintaining circular symmetry. An initial position is selected for the center of the bootlace lens outer surface ($z(\rho)$). The ray path normal to the phase front in the base plane (x,y) of the dome passing through this initial point is solved for. An initial lens thickness and path delay ($S_o$) is selected completing the initial conditions of the bootlace lens design. An initial value of $\rho_i$ is selected and the bootlace lens design is iterated to determine $z_1$, $z'_1$, $\rho'_1$ and $S'_1$, which minimize the rms error along the corresponding ring of constant phase. This procedure is continued for each value of $\rho'_o$ until the complete lens is designed.

(3) The phase front generated by the bootlace lens is projected back onto the (x,y) plane and the phase error function is computed by taking the difference between these values and the original dome phase function.

(4) The dome lens design is then altered to change the phase function requirements for the focal beam such as to reduce the difference between the dome phasing requirements and the phase front generated by the bootlace lens. It is noted that this may necessitate altering not only the dome shape parameters but also its gain transformation (gain tailoring) characteristics. A new phase function is generated and the bootlace lens is redesigned. This procedure is repeated until the best integrated design is obtained.

Figure 7:
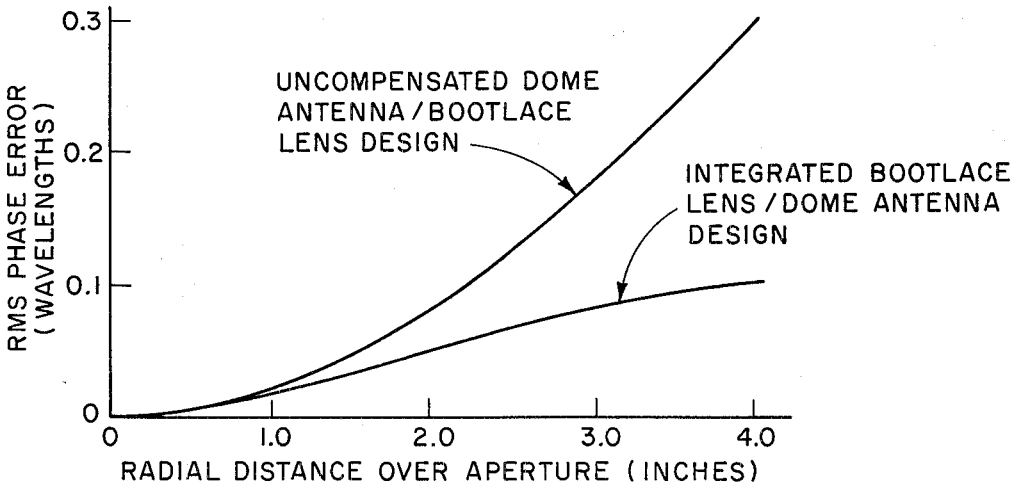
FIG. 7 is a phase plot illustrating the performance of the multi-beam multi-lens microwave antenna of the present invention.

Results demonstrating the improved performance when a dome lens design is integrated with a 3-D focal ring bootlace lens design is shown in FIG. 7, which shows the difference in rms path length error across the bootlace lens aperture at twelve (12) Ghz. From these results it can be seen that roughly a 3:1 reduction in rms phase error is obtained by integrating the dome design with that of the bootlace lens, selecting the horizon beam as the focal beam direction. It is noted that a flat-planar outer surface was assumed for the bootlace lens aperture.

In summary, the novel multi-beam multi-lens antenna of the present invention provides multi-beam coverage over a hemisphere or greater three-dimensional spatial coverage region. In its simpliest configuration, the antenna comprises two microwave lenses whose design is integrated to minimize path length errors and aberrations for beams over a 360° azimuth coverage range. The antenna comprises a 3-D focal ring bootlace first microwave lens that is a figure of revolution and a non-planar dome second microwave lens which provides the refractive properties necessary to obtain the hemispheric coverage while providing additional degrees of freedom necessary to reduce errors and aberrations of the lens system to acceptable levels. Both lenses are time delay lenses to effect broadband operation and are circularly symmetric. This symmetry results in antenna performance that is invariant with azimuth beam position. The parameters that are available for design optimization include the bootlace lens inner and outer surface contours, the interconnecting delay lines, the relative radial positioning of the lens elements on the inner and outer surface, the dome lens surface contours and the dome delay lines in the constrained embodiment or gradient function in the dielectric embodiment. These parameters are determined to provide a minimum rms path length error across the radiating aperture in the desired beam directions.

It is to be clearly understood that many modifications of the present invention may be effected without departing from the scope of the appended claims.

What is claimed is:

1. A multi-beam microwave antenna providing wide-angle coverage comprising:

a first plurality of beamports constrained to lie along a first focal ring which corresponds to a first preselected elevation;

a second plurality of beamports constrained to lie along a second focal ring which corresponds to a second preselected elevation;

a non-planar dome microwave lens substantially subtending a hemisphere; and a multi-beam 3-D bootlace microwave lens positioned between said beamports and said non-planar microwave lens for electromagnetically coupling respective ones of said beamports to corresponding preselected apertures of said non-planar dome microwave lens the field of view of which displays a 360° azimuth at a preselected elevation.

2. A multi-beam microwave antenna providing wide-angle coverage, as recited in claim 1, wherein said plurality of beamports are concentrically disposed symmetrically about the axis of said antenna.

3. A multi-beam microwave antenna providing wide-angle coverage, as recited in claim 1, wherein said non-planar dome microwave lens is of the dielectric type.

4. A multi-beam microwave antenna providing wide-angle coverage, as recited in claim 3, wherein said dielectric non-planar dome microwave lens is a figure of revolution and comprises a core of a dielectric material and overlayed outer and inner matching structures the dielectric constant for which is intermediate that of the core material and free space.

5. A multi-beam microwave antenna providing wide-angle coverage, as recited in claim 4, wherein said dielectric non-planar dome microwave lens has a gradient characterized by rings that vary along the elevation angle.

6. A multi-beam microwave antenna providing wide-angle coverage, as recited in claim 1, wherein said non-planar dome microwave lens is of the constrained type.

7. A multi-beam microwave antenna providing wide-angle coverage, as recited in claim 6, wherein said constrained non-planar dome microwave lens is a figure of revolution and comprises a housing having inner and outer selectively contoured surfaces, a like plurality of collector and radiator elements arranged at an interelement spacing of at most substantially one-half wavelength on said inner and said outer selectively contoured surfaces respectively, and a like plurality of electromagnetic conduits interconnecting preselected ones of said radiator and said collector elements along rings of equal electrical length for a given elevation.

8. A multi-beam microwave antenna providing wide-angle coverage, as recited in claims 3 or 6, wherein said 3-D bootlace microwave lens comprises a housing having first and second selectively contoured surfaces, a like plurality of collector and radiator elements respectively mounted on said first and said second selectively contoured surfaces at an interelement spacing of at most substantially a half-wavelength, and a like plurality of preselected lengths of electromagnetic conduit interconnecting preselected ones of said radiator and said collector elements along radial rings of the same electrical length.

* * * * *